United States Patent [19]

Eggert et al.

[11] Patent Number: 4,539,441

[45] Date of Patent: Sep. 3, 1985

[54] HEARING-AID WITH INTEGRATED CIRCUIT ELECTRONICS

[75] Inventors: Albert Eggert, Berlin; Rainer Goldschmidt, Freiburg-Munzingen, both of Fed. Rep. of Germany

[73] Assignee: Robert Bosch GmbH, Stuttgart, Fed. Rep. of Germany

[21] Appl. No.: 409,560

[22] Filed: Aug. 19, 1982

[30] Foreign Application Priority Data

Sep. 3, 1981 [DE] Fed. Rep. of Germany ..... 3134888

[51] Int. Cl.[3] ..... H04R 3/00

[52] U.S. Cl. ..... 179/111 E; 179/107 E; 323/223

[58] Field of Search ..... 179/107 R, 107 E, 111 E, 179/107 FD; 323/223, 225, 226, 229

[56] References Cited

U.S. PATENT DOCUMENTS

| | | | |
|---|---|---|---|
| 3,939,396 | 2/1976 | Larson | 323/223 |
| 4,068,090 | 1/1978 | Komatsu | 174/107 R |
| 4,117,275 | 9/1978 | Miyanaga | 179/111 E |
| 4,268,725 | 5/1981 | Nakagawa | 179/111 E |
| 4,281,222 | 7/1981 | Nakagawa | 179/111 E |
| 4,385,209 | 5/1983 | Greason | 179/111 |

FOREIGN PATENT DOCUMENTS

| | | | |
|---|---|---|---|
| 2089170 | 6/1982 | United Kingdom | 179/111 E |

OTHER PUBLICATIONS

"The ELZ Electret Transmitter," *Bell System Tech. Journal*, vol. 58, No. 7, Sep. 1979.

Bosch Publication No. 6 DRC.

*Primary Examiner*—Gene Z. Rubinson

*Assistant Examiner*—L. C. Schroeder

*Attorney, Agent, or Firm*—Frishauf, Holtz, Goodman & Woodward

[57] ABSTRACT

A hearing-aid has an electronic voltage stabilizing circuit (16) to compensate for change in supply voltage due to battery (18) aging and use. The electret microphone (11) is located within a housing, the voltage stabilizing circuit (16) being located within the same microphone housing, thus requiring no additional space or terminal connections. Preferably, an impedance transformer is provided; the electronic components (31–34) are placed on the same semi-conductor chip as the components (35, 36) of the voltage stabilizing circuit.

13 Claims, 2 Drawing Figures

HEARING-AID WITH INTEGRATED CIRCUIT ELECTRONICS

The present invention relates to a hearing-aid, particularly of the electret-microphone type, and more particularly to a hearing-aid with an integral miniaturized voltage stabilizer circuit manufactured by integrated circuit technology.

BACKGROUND

A hearing-aid device with electret-microphone has been described in Bosch Publication No. 6 DRV, and in VKD No. 8 699 944 398-1131. Such a hearing-aid requires a voltage stabilizer circuit, which is connected in parallel to the battery powering the hearing-aid. The discrete components of the stabilizer circuit are located, on the common behind-the-ear-type of hearing-aid, on a printed circuit board. Space restrictions on the crowded circuit board place a lower limit on the possible size of such a hearing-aid and also limit the possibilities of upgrading the device performance by addition of further features.

THE INVENTION

It is an object to provide the hearing-aid with a voltage stabilizer circuit which requires no increase in overall volume of the device.

Briefly, the hearing-aid includes a microphone, preferably of the electret type which is located within the microphone structure. The voltage stabilizer circuit is built by integrated circuit technology on a single semiconductor chip and located within the hearing-aid structure. An impedance transformer preferably is used, which may employ a field effect transistor (FET). The FET can thus also be located on the same single integrated circuit chip together with the voltage stabilizer circuit and the various other active and passive components of the electret microphone. The voltage stabilizer circuit is important in order to compensate for decreasing voltage supplied by the device battery due to battery aging and use.

DRAWINGS

Figure 1:
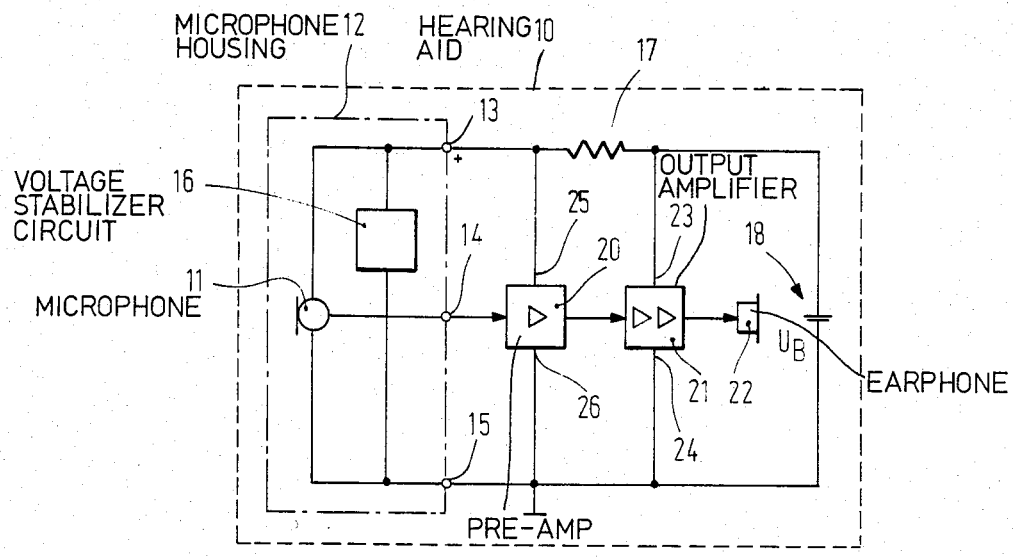
Figure 2:
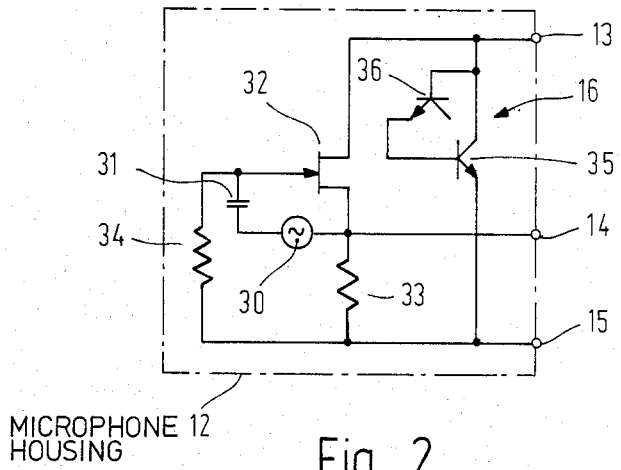

FIG. 1 is a block circuit diagram showing, schematically, a hearing-aid with a voltage stabilizer circuit; and FIG. 2 shows a detail of an electret microphone circuit.

The hearing-aid device 10—see the block circuit diagram of FIG. 1—preferably of the type carried behind the ear, has a microphone 11. Microphone 11 preferably is of the electret microphone type. The structure, or housing thereof is shown by chain dotted lines 12. Microphone 11 has three electric terminals 13, 14, 15. The structure 12 has a voltage stabilizer circuit 16 connected between terminals 13 and 15. Terminal 13 is connected through a series resistor 17 with one terminal, for example the positive pole terminal of battery 18; terminal 15 is connected directly to the other pole, then the negative of battery 18, to provide a circuit voltage $U_B$. Terminal 14, which carries the variable signal voltage output from microphone 11, is connected to the input side of a preamplifier 20, which is itself connected, through the output amplifier 21 to the earphone 22 of the hearing-aid device.

Terminals 23 and 24 of the output 21 are in direct connection with battery 18, receiving d-c voltage $U_B$. Terminal 25 of the preamplifier 20 is connected to the positive pole of the battery through series resistor 17 and terminal 26 is directly connected to the negative pole of the battery 15.

FIG. 2 shows details of the circuit contained within the structure 12 of microphone 11. In FIG. 2, the microphone is denoted by 30 and represented for simplicity as an alternating current source. One side of the microphone 30 is connected through capacitor 31 to the gate electrode of FET 32, while the other side of the microphone 30 is connected to the source electrode of FET 32, and the drain electrode of FET 32 is connected to terminal 13. The source electrode of the FET 32 is directly connected to terminal 14 and is connected through resistor 33 with terminal 15 and through resistors 33 and 34 with the gate electrode of FET 32. The voltage stabilizing circuit between terminals 13 and 15 comprises a transistor 35 and a diode 36. The diode 36 may in fact be constructed in form of a second transistor whose collector is left unconnected to the circuit. The collector and emitter of the first transistor 35 are electrically in parallel to terminals 13 and 15, while the collector and base of transistor 35 are connected to the base and emitter, respectively, of the transistor 36 which forms the diode in the voltage stabilizing circuit 16.

OPERATION

The FET 32 serves as an impedance transformer, to match the high impedance of the microphone system 30 to the input impedance of the preamplifier 20. The voltage stabilizing circuit 16 is intended to insure that the FET 32, the preamplifier 20 and the output amplifier 21 remain at a nearly constant supply voltage despite decreasing battery voltage due to battery aging. Since the voltage stabilizing circuit is located within the structure 12 of microphone 11, its introduction into the device requires no additional volume. The semiconductor components 35 and 36 of the voltage stabilizing circuit 16 and of the FET 32, as well as resistors 33 and 34 and capacitor 31 are preferably integrated on a single chip by use of integrated circuit technology. The circuits of the pre- and output amplifiers 20 and 21, respectively, can then be made by well known methods and to standard dimensions well established for a hearing-aid.

Various changes and modifications may be made within the scope of the inventive concept.

We claim:

1. A miniaturized, battery-weakening-compensated hearing-aid device (10) including a microphone (11);

a microphone housing structure (12) within the hearing-aid device (10);

a sound amplifier (20,23) to amplify the electric signal from the microphone;

an earphone (22) receiving the amplified signals from the sound amplifier;

a current supply battery (18) powering the hearing-aid device; and means for compensating for decreases in the output voltage of said battery as it ages and weakens;

wherein, in accordance with the invention, said compensating means comprises an integrated voltage stabilizer circuit (16) located, for miniaturization purposes, within the microphone housing (12) of the microphone and connected in parallel to the microphone (11).

2. A hearing-aid device according to claim 1, wherein the voltage stabilizing circuit comprises two transistors (35,36);

the collector of one transistor (35) being connected in parallel to the current supply terminals (13, 15) of the microphone, the collector and the emitter of said one transistor being connected to the base, and the emitter, respectively of the other transistor (36);

and wherein said other transistor is connected as a diode.

3. A hearing-aid device according to claim 2, wherein said other transistor has the base terminal and one other terminal connected in circuit, the third terminal of the transistor being left free and unconnected.

4. A hearing-aid device according to claim 3, wherein the other transistor has its base and emitter, respectively, connected to said first transistor, the collector being left free.

5. A hearing-aid device according to claim 1, wherein the housing (12) of the microphone has three terminals comprising two current supply terminals (13, 15) connected to the current supply battery (18) and a signal terminal (14) connected to the sound amplifier (20, 23), the voltage stabilizer circuit being connected across the current supply terminals whereby the voltage stabilizer circuit and the microphone form one integral replaceable, and separately connectable unit.

6. A hearing-aid device according to claim 5, wherein an impedance transformer (32) is provided, and the microphone (11) is of the electret microphone type, the impedance transformer being located within the microphone housing structure (12).

7. A miniaturized, battery-weakening-compensated hearing-aid device including the microphone (11);

a microphone housing structure (12) within the hearing-aid device;

a sound amplifier (20,23) to amplify the electric signal from the microphone;

an earphone (22) receiving the amplified signals from the sound amplifier;

a current supply battery (18) powering the hearing-aid device;

and a voltage stabilizer circuit (16), connected to the battery, the microphone, and the sound amplifier, wherein, in accordance with the invention, the voltage stabilizer circuit is located within the microphone housing (12) of the microphone and is connected in parallel to the microphone;

and wherein an impedance transformer (32) is provided, and the microphone (11) is of the electret microphone type, the impedance transformer being located within the microphone housing structure (12).

8. A hearing-aid device according to claim 7, wherein the voltage stabilizing circuit (16) comprises electronic components or circuit elements (35, 36);

the impedance transformer comprises electronic components or circuit elements (31–34); and wherein the electronic components of the voltage stabilizing circuit and of the impedance transformer are integrated onto a single semi-conductor chip.

9. A hearing-aid device according to claim 7, wherein the voltage stabilizing circuit (16) comprises electronic components or circuit elements (35, 36);

the impedance transformer comprises electronic components or circuit elements (31–34);

wherein the electronic components of the voltage stabilizing circuit and of the impedance transformer are integrated onto a single semi-conductor chip, all located within said microphone housing.

10. A hearing-aid device according to claim 2, wherein the voltage stabilizing circuit comprises two transistors (35, 36);

the collector of one transistor (35) being connected in parallel to the current supply terminals (13, 15) of the electret microphone (11), the collector and the emitter of said one transistor (35) being connected respectively to the base and the emitter of the other transistor (36); and wherein the other transistor (36) is connected as a diode.

11. A hearing-aid device according to claim 10, wherein said other transistor (36) has the base terminal and one other terminal connected in circuit, the third terminal of the transistor (36) being left free and unconnected.

12. A hearing-aid device according to claim 11, wherein the other transistor (36) has its base and emitter, respectively, connected to said first transistor (35), the collector being left free.

13. A hearing-aid device according to claim 2, wherein the housing (12) of the microphone has three terminals, comprising two current supply terminals (13, 15) connected to the current supply battery (18) and a signal terminal (14) connected to the sound amplifier (20, 23), the voltage stabilizer circuit being connected across the current supply terminals (13, 15), whereby the voltage stabilizer circuit (16) and the microphone (11) form one integral, replaceable, and separately connectable unit.

* * * * *

UNITED STATES PATENT AND TRADEMARK OFFICE

CERTIFICATE OF CORRECTION

PATENT NO. : 4,539,441

DATED : September 3, 1985

INVENTOR(S) : Albert EGGERT et al

It is certified that error appears in the above-identified patent and that said Letters Patent is hereby corrected as shown below:

Claim 10, line 1 (column 4, line 21) change "claim 2" to -- claim 7 --

Claim 13, line 1 (column 4, line 41) change "claim 2" to -- claim 7 --

Signed and Sealed this

*Twenty-fifth* Day of *February 1986*

[SEAL]

*Attest:*

DONALD J. QUIGG

*Attesting Officer*

*Commissioner of Patents and Trademarks*